US005358073A

United States Patent [19]

Wöthrich

[11] Patent Number: 5,358,073

[45] Date of Patent: Oct. 25, 1994

[54] METHOD AND APPARATUS FOR TENSIONING AN ACCUMULATOR SPRING OF A DRIVE OF A HIGH-VOLTAGE OR MEDIUM-VOLTAGE POWER CIRCUIT BREAKER

[75] Inventor: Hans-Rudolf Wöthrich, Oberentfelden, Switzerland

[73] Assignee: Sprecher Energie AG, Oberentfelden, Switzerland

[21] Appl. No.: 24,088

[22] Filed: Mar. 1, 1993

[30] Foreign Application Priority Data

Feb. 28, 1992 [CH] Switzerland ..... 00635/92

[51] Int. Cl.[5] ..... F03G 1/08; H01H 3/30

[52] U.S. Cl. ..... 185/43; 185/40 R; 200/400

[58] Field of Search ..... 185/13, 40 R, 43; 200/400; 368/209

[56] References Cited

U.S. PATENT DOCUMENTS

| | | | |
|---|---|---|---|
| 1,266,280 | 5/1918 | Kocourek | 185/40 R |
| 2,674,345 | 4/1954 | Favre | 200/400 |
| 3,490,547 | 1/1970 | Stewart | 173/29 |
| 3,600,540 | 8/1971 | Bould | 200/400 |
| 3,732,949 | 5/1973 | Williams | 185/40 R |
| 4,083,270 | 4/1978 | Tohkinson | 173/181 X |
| 4,409,449 | 10/1983 | Takano et al. | 200/153 SC |
| 4,968,861 | 11/1990 | Kuhn | 200/400 |
| 4,996,397 | 2/1991 | Kuhn et al. | 200/144 B |
| 5,015,809 | 5/1991 | Wüthrich | 200/144 R |
| 5,016,501 | 5/1991 | Holzer, Jr. | 173/181 X |
| 5,055,640 | 10/1991 | Lippi et al. | 200/144 B |
| 5,113,056 | 5/1992 | Kuhn | 200/400 |

FOREIGN PATENT DOCUMENTS

| | | |
|---|---|---|
| 0321594 | 6/1989 | European Pat. Off. . |
| 2524017 | 12/1976 | Fed. Rep. of Germany . |
| 2603942 | 8/1977 | Fed. Rep. of Germany . |

OTHER PUBLICATIONS

Sprecher Energie, No. 4106 (Prior Mar. 1, 1993).
Sprecher Energie, No. 42B1A (Prior Mar. 1, 1993).

*Primary Examiner*—Allan D. Herrmann
*Attorney, Agent, or Firm*—Keck, Mahin & Cate

[57] ABSTRACT

A method and apparatus for tensioning the accumulator spring of a high-voltage or medium-voltage power circuit breaker drive, in which a drilling machine or a power tool, such as a screwdriver, which is powered by a rechargeable battery, is used.

7 Claims, 1 Drawing Sheet

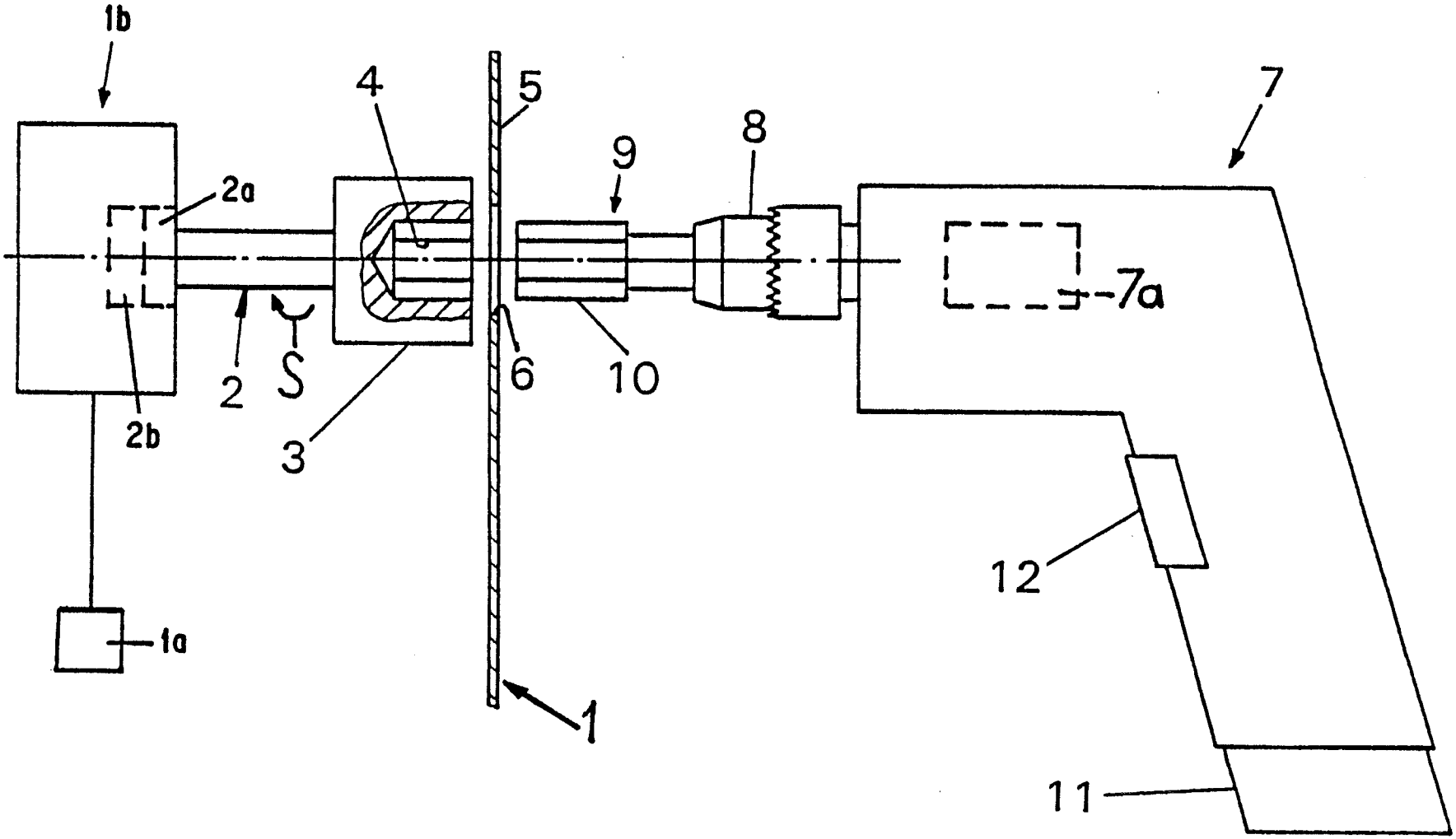
7
7a
12
11
8
9
10
1
5
6
4
3
S
2
2a
2b
1b
1a

METHOD AND APPARATUS FOR TENSIONING AN ACCUMULATOR SPRING OF A DRIVE OF A HIGH-VOLTAGE OR MEDIUM-VOLTAGE POWER CIRCUIT BREAKER

FIELD OF INVENTION

The invention relates to a method and apparatus for tensioning an accumulator spring of a drive of a high-voltage or medium-voltage power circuit breaker, and to a power circuit breaker.

BACKGROUND OF INVENTION

In the case of a known drive for a power circuit breaker, such as in the case of the FK/FH 2–40 drive shown on pages 21 to 23 in the SPRECHER ENERGIE AG Document 4106 "Oelarme Leistungsschalter HP 300, 1250 . . . 4000 A für Innenraumanlagen bis 24 kV" [HP300, 1250 . . . 4000 A power circuit breakers with little oil for internal installations up to 24 kV], the force accumulator spring is tensioned using a crank or, optionally, also using a built-in electric motor. When not in use, the crank is suspended at the front on the drive.

In the case of another spring-force drive for high-voltage circuit breakers, which is shown in FIG. 18 on page 9 in the SPRECHER ENERGIE AG Document 42B1A "SF6-Leistungsschalter 72,5 bis 420 kV Typenreihe HGF100 für Freiluftaufstellung" [72.5 to 420 kV HGF100 Series SF6 power circuit breakers for open-air installation], the accumulator spring is normally tensioned by means of the built-in electric motor. For emergency operation, it has a crank which can be plugged onto the drive shaft of the spring cage. The connection between the drive shaft and the crank takes place by means of a claw coupling whose claws are constructed like saw teeth, so that the coupling acts only in the direction in which the spring is tensioned. If the spring accumulator of one of the aforementioned drives has to be tensioned without the involvement of a motor, possibly because no motor is installed in the drive or possibly because, for example, the relevant power circuit breaker has been switched off and no electrical energy is available for supplying the built-in motor, a large amount of muscular work is required by the person operating the circuit breaker. In addition, tensioning the accumulator spring using a crank requires a large amount of time. This may be highly unwelcome, particularly when, as a consequence of a severe disturbance, for example during a thunderstorm, the accumulator springs of the drives of a plurality of power circuit breakers must be tensioned.

SUMMARY OF INVENTION

The object of the present invention is therefore to ease the work of that person who is required to tension the accumulator spring of a power circuit breaker without a built-in lifting motor or in the event of failure of the motor supply, and make quicker tensioning possible than by using the hand crank.

This object is achieved by means of the inventions as claimed.

DESCRIPTION OF DRAWING

The invention is explained in more detail using the single drawing.

DETAILED DESCRIPTION OF PREFERRED EMBODIMENT

The drawing shows a section of the drive 1 of a power circuit breaker. The drive 1 contains an accumulator spring la which can be tensioned via a transmission 1*b* which is shown only by way of indication in block form.

The transmission 1*b* is driven by a drive shaft 2 via a freewheeling device 2*a* such as a known ratchet mechanism that drives in one preselected direction and slips in the other direction, which is only indicated in block form. The freewheeling device 2*a* ensures that the drive shaft 2 is coupled to the transmission 1*b* only when said drive shaft 2 is rotated in the direction S of tensioning of the accumulator spring 1*a*.

A further device 2*b* such as a known clutch mechanism, which is shown by way of indication in block form in the figure, ensures that the drive shaft 2 is decoupled from the transmission 1*b* or is blocked when the accumulator spring 1*a* is completely tensioned.

Embodiments both for the arrangement of the freewheeling device 2*a* and for a device 2*b* for decoupling the drive shaft 2 from the transmission 1*b* are known, e.g., from published Swiss Patent Application 02 660/91-0 dated Sep. 10, 1991.

A hexagonal socket 4 is formed in, incorporated into or fixed onto the end 3 of the drive shaft 2 facing away from the transmission 1*b*, so that the end appears like the head of a screw having a hexagonal socket. An opening 6 of the covering or housing 5 of the circuit breaker drive 1 is located opposite and in axial registry with the end 3 of the drive shaft 2.

An electric screwdriver 7 which is equipped with an electric motor 7*a* and has a screwdriver insert 9 which is inserted into the chuck 8 of the electric screwdriver 7, is used for tensioning the accumulator spring 1*a*. The end of the screwdriver insert 9 forms an Allen key 10 which fits the hexagonal socket 4.

The electric screwdriver 7 is advantageously equipped with a rechargeable battery 11 and is supplied from said battery 11. In this case, the electric screwdriver 7 is independent of the local availability of a plug socket.

If the accumulator spring 1*a* of a circuit breaker drive 1 now has to be tensioned, the electric screwdriver 7 is plugged, with the screwdriver insert 9 inserted, through the opening 6 into the hexagonal socket 4, and is set in operation by actuating the switch 12. In the event of the electric screwdriver 7 rotating in the wrong direction or when spring 1*a* is fully tensioned, the freewheeling device 2*a* prevents the circuit breaker drive 1 being damaged.

If the accumulator spring 1*a* is completely tightened, the drive shaft 2 is mechanically blocked, as the drive 1 may be correspondingly equipped with the blocking device 2*b*. When dimensioning the blocking device 2*b*, care must be taken to ensure that it can withstand the torque exerted by the electric screwdriver 7 when stationary.

It is better if the drive shaft 2 is completely decoupled from the transmission 1*b* when the accumulator spring la is completely tensioned, such as by a suitable slip clutch. Damage to the drive 1 is then prevented in all cases.

Using the apparatus and method according to the present invention, the accumulator springs of a plurality of power circuit breakers can be tensioned within a short time, without exhausting the operator. The screwdriver required for this purpose is available in virtually every toolbox. The circuit breaker can be equipped for the method at little cost.

What is claimed is:

1. An apparatus for tensioning an accumulator spring of a power circuit breaker including a housing for the spring and a drive path leading from an input accessible from outside the housing to the spring for tensioning same the improvement comprising the input being formed for engagement by a tool operated by a cordless power tool holder;

A freewheeling mechanism located in the drive path to allow driving only in a direction for increasing tension of the spring; and an interrupt mechanism located in the drive path to interrupt torque to the spring when fully tensioned.

2. In apparatus according to claim 1 wherein the input is formed as a hex socket.

3. In apparatus according to claim 1 wherein the freewheeling mechanism is a ratchet.

4. In apparatus according to claim 1 wherein the interrupt mechanism is a clutch.

5. In apparatus according to claim 1 wherein the interrupt mechanism acts to mechanically block the drive path.

6. In apparatus according to claim 1 wherein the input is formed as a drivable screw head.

7. A method for tensioning an accumulator spring of a drive of a high-voltage or medium-voltage power circuit breaker, comprising the steps of a) establish a drive path from an input to the accumulator spring, b) inputing power to the input via a cordless hand held power tool, c) driving the spring in a tensioning direction only, d) interrupting the drive path responsive to fully tensioning the spring.

* * * * *